US009972202B2

(12) United States Patent
Koshizen

(10) Patent No.: US 9,972,202 B2
(45) Date of Patent: May 15, 2018

(54) DRIVING SUPPORT METHOD, PROGRAM, AND DRIVING SUPPORT DEVICE

(71) Applicant: HONDA MOTOR CO., LTD., Tokyo (JP)

(72) Inventor: Takamasa Koshizen, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days. days.

(21) Appl. No.: 15/095,624

(22) Filed: Apr. 11, 2016

(65) Prior Publication Data

US 2016/0307444 A1 Oct. 20, 2016

(30) Foreign Application Priority Data

Apr. 14, 2015 (JP) ..... 2015-082398

(51) Int. Cl.
*G08G 1/01* (2006.01)
*G08G 1/09* (2006.01)
*G08G 1/0967* (2006.01)

(52) U.S. Cl.
CPC ..... *G08G 1/0133* (2013.01); *G08G 1/0112* (2013.01); *G08G 1/0145* (2013.01); (Continued)

(58) Field of Classification Search
CPC .. G08G 1/0133; G08G 1/0112; G08G 1/0145; G08G 1/096716; G08G 1/096758
See application file for complete search history.

(56) References Cited

U.S. PATENT DOCUMENTS 9,031,761 B2 * 5/2015 Koshizen ..... B60W 30/16 701/96
9,418,554 B2 * 8/2016 Velusamy ..... G08G 1/162
2013/0282264 A1 * 10/2013 Bastiaensen ..... G01C 21/3492 701/119

FOREIGN PATENT DOCUMENTS

JP 2006-079356 A 3/2006
JP 2010-36862 A 2/2010
(Continued)

OTHER PUBLICATIONS

Office Action dated Dec. 6, 2016, issued in counterpart Japanese Patent Application No. 2015-082398, with English translation. (4 pages).

*Primary Examiner* — Todd Melton
(74) *Attorney, Agent, or Firm* — Westerman, Hattori, Daniels & Adrian, LLP

(57) ABSTRACT

A driving assistance method executed by a driving assistance device including a tri-axial accelerometer, an information presentation controller, and an information presentation section. The driving assistance method includes: a congestion warning sign information acquisition step for acquiring congestion warning sign information based on change in the acceleration; a multi-lane information acquisition step for acquiring information regarding whether or not the position of the driving assistance device is on a multiple lane travel path; a restriction information presentation step for presenting information indicating lane change restriction when the position is on the multiple lane travel path and congestion warning sign information indicates traffic flow tending toward congestion; and a non-restriction information presentation step for presenting information indicating non-restriction of lane change when the position is on the multiple lane travel path and congestion warning
(Continued)

sign information does not indicate traffic flow tending toward congestion.

9 Claims, 9 Drawing Sheets

(52) U.S. Cl.
CPC . *G08G 1/096716* (2013.01); *G08G 1/096758* (2013.01); *G08G 1/096775* (2013.01); *G08G 1/096791* (2013.01)

(56) References Cited

FOREIGN PATENT DOCUMENTS

| | | | |
|---|---|---|---|
| JP | 2012-127772 | A | 7/2012 |
| WO | 2014/142057 | A1 | 9/2014 |

* cited by examiner

DRIVING SUPPORT METHOD, PROGRAM, AND DRIVING SUPPORT DEVICE

CROSS REFERENCES TO RELATED APPLICATIONS

The present application claims priority under 35 U.S.C. § 119 to Japanese Patent Application No. 2015-082398, filed Apr. 14, 2015, entitled "Driving Assistance Method, Program, and Driving Assistance Device." The contents of this application are incorporated herein by reference in their entirety.

BACKGROUND

1. Field

The present application relates to a driving assistance method, program, and driving assistance device.

2. Description of the Related Art

Driving assistance devices are known that prompt lane change when it can be determined that a traffic flow is in a transitional state from a freely flowing state with a low possibility of congestion occurring to a mixed flow state where braking states and acceleration states of vehicles are mixed (see, for example, Japanese Unexamined Patent Application Publication No. 2012-127772.)

Moreover, driving control devices are also known that perform driving control to make vehicle lane changes to high traffic density lanes less liable to occur, so as to make a decrease in inter-vehicle distance less liable to occur as the traffic density for vehicles that have changed lane to a high density lane approaches a critical region (see, for example, Japanese Unexamined Patent. Application Publication No. 2010-035862). In such a driving control device, the occurrence of congestion is suppressed, and congestion is alleviated, by causing a vehicle under driving control in a lane that seems to be becoming congested to change lanes.

The driving assistance devices according to the above technique enable a vehicle to avoid getting caught in congestion in the current lane of travel by moving the vehicle to another lane in cases where there is a high possibility of congestion in the current lane. However, when a vehicle changes lanes, consideration needs to be given to the influence on congestion occurring in the other lanes and to the behavior of other vehicles. When a vehicle decelerates due to vehicles changing lane, this deceleration propagates to a vehicle following, and deceleration also propagates in sequence to another vehicle following that resulting in deceleration of many vehicles traveling in the lane. This deceleration of many vehicles in this lane sometimes causes some vehicles to change lanes, and there are cases where it is not possible to suppress overall congestion across multiple lanes.

Moreover, the driving control devices according to the above technique are sometimes able to change a state toward suppression and alleviation of congestion by entering a lane which seems to be becoming congested. However, due to high traffic volumes at the stage when warning signs of becoming congested are present, sometimes the state is changed toward promoting the occurrence of congestion when frequently changing lanes. Moreover, in order to change the state toward suppression or alleviation of congestion, there is a need for other vehicles driving in a given lane to predict in advance the driving state of a vehicle entering the lane, and to match to the driving state of that vehicle, creating a need to control all the vehicles with a common system.

SUMMARY

In consideration of the above circumstances, the present application describes a driving assistance method, program, and driving assistance device capable of appropriately suppressing congestion overall in multiple lanes.

The present application has the following aspects.

(1) A driving assistance method according to a first aspect of the present application is a driving assistance method executed by an electronic device (for example, a driving assistance device 10 in an embodiment) that includes an acceleration acquisition section (which can also simply be referred to as an acceleration acquisition device) that acquires acceleration (for example, a tri-axial accelerometer 14 in the above embodiment), and an information presentation section (which can also simply be referred to as an information presentation device) that presents information (for example, an information presentation controller 26 and a display device 16 in the above embodiment). The method includes the following steps. A congestion warning sign information acquisition step (for example, step S01 to step S12 in the above embodiment), in which the electronic device acquires congestion warning sign information based on a change in the acceleration acquired by the acceleration acquisition section. A multi-lane information acquisition step (for example, step S13 in the above embodiment), in which the electronic device acquires information regarding whether or not a position of the electronic device is on a travel path having multiple lanes. A restriction information presentation step (for example, step 17 in the above embodiment), in which the information presentation section presents information indicating that lane change is restricted in cases where the position of the electronic device is on a travel path having multiple lanes and the congestion warning sign information indicates a change in traffic flow tending toward congestion. A non-restriction information presentation step (for example, step S19 and step S20 in the above embodiment), in which the information presentation section presents information indicating that lane change is not restricted in cases where the position of the electronic device is on a travel path having multiple lanes and the congestion warning sign information does not indicate a change in traffic flow tending toward congestion.

(2) The driving assistance method of (1) described above may further include a presentation operation change step (for example, step S17 and step S20 in the above embodiment) in which the electronic device changes an operational content of the information presentation section so as to present the information indicating lane change restriction or non-restriction according to a proportion of the number of driving assistance enabled vehicles to the total number of vehicles in a specific travel path range.

(3) In the driving assistance method of (1) or (2) described above, in the restriction information presentation step, the information presentation section may present the information indicating lane change restriction together with information prompting a change tending to reduce an inter-vehicle distance or inter-vehicle time.

(4) In the driving assistance method of any one of (1) to (3) described above, in the non-restriction information presentation step, the information presentation section may present information recommending a lane change as the information indicating non-restriction of lane change in cases where the electronic device has acquired information indicating a recommendation to travel in another lane based on road information or traffic information.

(5) A computer program according to an aspect of the present application is a computer program (which may also be provided as a computer program product or a computer readable medium storing the computer program) that causes a computer or a computer processor of an electronic device (for example, a driving assistance device 10 in the above embodiment) that includes an acceleration acquisition section that acquires acceleration (for example, a tri-axial accelerometer 14 in the above embodiment), and an information presentation section that presents information (for example, an information presentation controller 26 and a display device 16 in the above embodiment), to execute steps. The steps include the following. A congestion warning sign information acquisition step (for example, step S01 to step S12 in the above embodiment), in which the electronic device acquires congestion warning sign information based on a change in the acceleration acquired by the acceleration acquisition section. A multi-lane information acquisition step (for example, S13 in the above embodiment), in which the electronic device acquires information regarding whether or not a position of the electronic device is on a travel path having multiple lanes. A restriction information presentation step (for example, step 17 in the above embodiment), in which the information presentation section presents information indicating that lane change is restricted in cases where the position of the electronic device is on the travel path having multiple lanes and the congestion warning sign information indicates a change in traffic flow tending toward congestion. A non-restriction information presentation step (for example, step S19 and step S20 in the above embodiment), in which the information presentation section presents information indicating that lane change is not restricted in cases where the position of the electronic device is on the travel path having multiple lanes and the congestion warning sign information does not indicate a change in traffic flow tending toward congestion.

(6) In the program of (5) described above, the program may cause the computer of the electronic device to execute the steps, the steps further includes a presentation operation change step (for example, step 17 and step 20 in the above embodiment) in which the electronic device changes an operational content of the information presentation section so as to present the information indicating lane change restriction or non-restriction according to a proportion of the number of driving assistance enabled vehicles to the total number of vehicles in a specific travel path range.

(7) In the program of (5) or (6) described above, in the restriction information presentation step, the program may cause the information presentation section to present the information indicating lane change restriction together with information prompting a change tending to reduce an inter-vehicle distance or inter-vehicle time.

(8) In the program of any one of (5) to (7) described above, in the non-restriction information presentation step, the program may cause the information presentation section to present information recommending a lane change as the information indicating non-restriction of lane change in cases where the electronic device has acquired information indicating a recommendation to travel in another lane based on road information or traffic information.

(9) A driving assistance device according to an aspect of the present application is a driving assistance device including an acceleration acquisition section that acquires an acceleration (for example, a tri-axial accelerometer 14 in an embodiment), an information presentation section that presents information (for example, an information presentation controller 26 and a display device 16 in the embodiment), a congestion warning sign information acquisition section that acquires congestion warning sign information based on a change in the acceleration acquired by the acceleration acquisition section (for example, a congestion prediction section 25 in the embodiment), and a multi-lane information acquisition section that acquires information regarding whether or not the acceleration acquisition section and the information presentation section are present on a travel path having multiple lanes (for example, the information presentation controller 26 serves as both in the embodiment). The information presentation section presents information indicating that lane change is restricted in cases where the information acquired by the multi-lane information acquisition section indicates that the acceleration acquisition section and the information presentation section are present on a travel path having multiple lanes, and the congestion warning sign information acquired by the congestion warning sign information acquisition section indicates a change in traffic flow tending toward congestion. The information presentation section presents information indicating that lane change is not restricted in cases where the information acquired by the multi-lane information acquisition section indicates that the acceleration acquisition section and the information presentation section are present on the travel path having multiple lanes, and the congestion warning sign information acquired by the congestion warning sign information acquisition section does not indicate a change in traffic flow tending toward congestion.

(10) The driving assistance device of (9) described above may further include a presentation operation change section that changes an operational content of the information presentation section so as to present the information indicating lane change restriction or non-restriction according to a proportion of the number of driving assistance enabled vehicles to the total number of vehicles in a specific travel path range.

(11) In the driving assistance device of (9) or (10) described above, the information presentation section may present the information prompting a change that tends to reduce an inter-vehicle distance or inter-vehicle time when presenting information indicating lane change restriction.

(12) The driving assistance device of any one of (9) to (11) described above may further include a travel recommendation information acquisition section that acquires information indicating a recommendation to travel in another lane based on road information or traffic information (for example, the information presentation controller 25 serves as both in the embodiment above). In such cases, when presenting the information indicting non-restriction of lane change, the information presentation section may present information indicating a lane change recommendation as the information indicating non-restriction of lane change in cases where information has been acquired by the travel recommendation information acquisition section indicating a recommendation to travel in another lane used on the road information or the traffic information.

According to (1), (5), or (9) described above, disruption to traffic flow can be decreased due to suppressing lane changes based on congestion warning sign information, and, due to raising a congestion suppressing effect, an appropriate balance can be achieved between a direct reduction in speed accompanying lane changes, and recovery of the average speed in multi-lane traffic flow. Although there is the possibility that the average speed decreases due to vehicle-to-vehicle propagation of speed reduction in the lane a vehicle changing lanes is moving into, an increase in the average speed of overall traffic flow for multiple lanes can be achieved by appropriately dispersing vehicles that are disproportionately distributed in a particular lane to another lane. The in-car time can be shortened by lane change restriction based on the congestion warning sign information. Due to being able to achieve lane change restricted travel, a chain reaction of lane changes can be prevented from occurring, enabling an improvement in the stability of traffic flow.

Moreover, since lane change non-restriction is presented when the congestion warning sign information does not indicate a change in traffic flow tending toward congestion, dispersal of the traffic volume across multiple lanes is promoted, enabling the occurrence of congestion to be suppressed.

Moreover, in the case of (2), (6), or (10) described above, due to the operational content of the information presentation section being changed according to the proportion of driving assistance enabled vehicles, information can be effectively presented to restrict or non-restrict lane changes, while also appropriately corresponding to various traffic flow states. For example, the occurrence of congestion can be appropriately suppressed by having information presentation intervene less when the proportion of driving assistance enabled vehicles high, and by having information presentation intervene more when the proportion of driving assistance enabled vehicles is low. Since the regularity of traffic flow in multiple lanes increases as the proportion of driving assistance enabled vehicles increases, the occurrence of congestion can be suppressed by raising the degree of lane change restriction or by lowering the degree of lane change non-restriction. However, although the stability of traffic flow in multiple lanes falls as the proportion of driving assistance enabled vehicles decreases, the influence of lane changes by driving assistance enabled vehicles on other vehicles is also sometimes smaller. There is accordingly no need to raise the degree of lane change restriction compared to cases where there is a high proportion of driving assistance enabled vehicles. The degree of lane change restriction or non-restriction may be changed by the respective degree of forcefulness of the information for presentation, by the number of vehicles that perform information presentation.

Moreover, in the case of (3), (7), or (11) described above, in cases where the congestion warning sign information indicates traffic flow tending toward congestion, and there is a possibility that the average lane speed decreases due to lane changes, the occurrence of congestion can be suppressed by dispersing the traffic volume in each of the lanes by decreasing the inter-vehicle distance or inter-vehicle time while suppressing lane changes.

Moreover, in the case of (4), (8), or (12) described above, in cases where there is a disparity between the legal speed limit or the past average effective vehicle speed, and the actual speed, the overall average speed of traffic flow across multiple lanes can be increased by recommending lane changes, enabling congestion to be suppressed from occurring. Moreover, in cases such as those in which it is Ascertained, based on traffic information, that a speed limit is in force due to road works, an accident, or the like in the lane, congestion can be suppressed from occurring by promoting dispersion of vehicles across all of multiple lanes by recommending lane changes.

DESCRIPTION OF THE PREFERRED EMBODIMENTS

Figure 1:
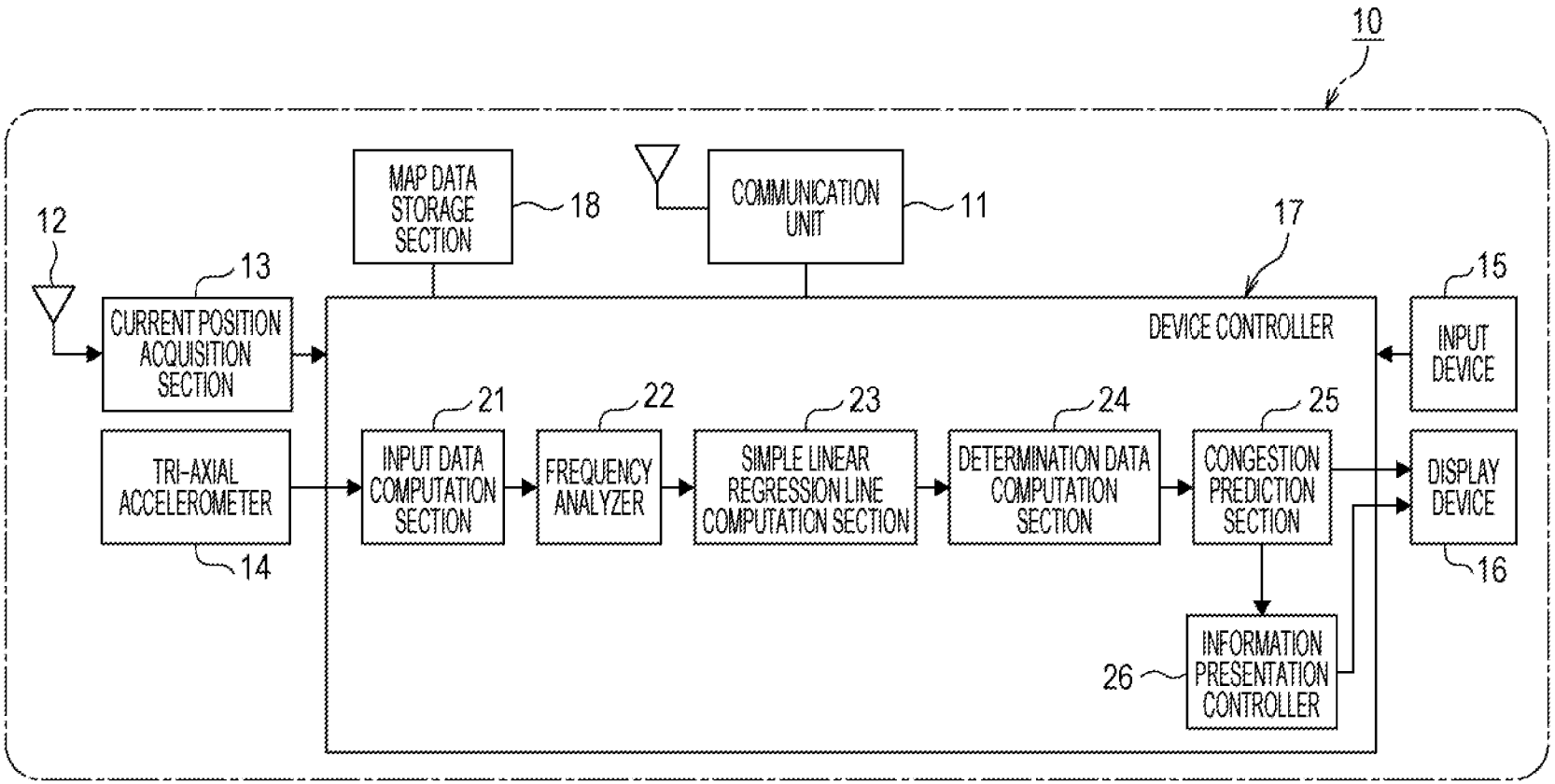
FIG. 1 is a configuration diagram of a driving assistance device that implements a driving assistance method according to an embodiment of the present application.

Explanation follows regarding an embodiment of a driving assistance method, program, and driving assistance device of the present application, with reference to the appended drawings.

A driving assistance device 10 of the present embodiment is, for example, a mobile terminal carried by an occupant of a moving body, such as a vehicle, or a detachable information system installed in a moving body, such as a vehicle, or an electronic device such as a navigation system preinstalled in a moving body, such as a vehicle.

The driving assistance device 10 is capable of two-way wireless communication with external devices over a communication network such as an ad hoc mode network, or an infrastructure mode network. The driving assistance device 10 performs, for example, two-way communication with is driving assistance device 10 of another vehicle using inter-vehicle communication in an ad hoc mode. The driving assistance device 10, for example, performs two-way communication with an external device through a base station using wireless communication in an infrastructure mode.

The driving assistance device 10 includes a communication unit 11, a positioning signal receiver 12, a current position acquisition section 13, a tri-axial accelerometer 14, an input device 15, a display device 16, a device controller 17, and a map data storage section 10.

The communication unit 11 is capable of communicating with an external device over various wireless communication network systems, and transmits and receives various signals. The communication between the driving assistance device 10 and external devices is not limited to the communication modes described above, and other types of communication may be adopted such as, for example, communication via a communication satellite.

The positioning signal receiver 12 receives, for example, a positioning signal employed by a positioning system (for example, a Global Positioning System (GPS) or a Global Navigation Satellite System (GNSS)) that utilizes artificial satellites to determine the position of the driving assistance device 10.

The current position acquisition section 13 utilizes the positioning signal received by the positioning signal receiver 12 to detect the current position of the driving assistance device 10.

The tri-axial accelerometer 14 is, for example, tri-axial accelerometer having three so-called detection axes. The tri-axial accelerometer 14 detects, with a specific sampling period, the acceleration occurring in the driving assistance device 10 as acceleration in each axial direction of an X-axis, a Y-axis, and a Z-axis configuring a coordinate system in three-dimensional space.

The input device 15 is, for example, provided with a switch, touch panel, keyboard, and/or voice input device, and outputs a signal according to various operations input by an operator.

The display device 16 is, for example, one of various types of display, such as a liquid crystal display, and displays various information output from the device controller 17.

The device controller 17 controls various operations of the driving assistance device 10.

The device controller 17 includes an input data computation section 21, a frequency analyzer 22, a simple linear regression line computation section 23, determination data computation section 24, a congestion prediction section 25, and an information presentation controller 26.

Figure 2:
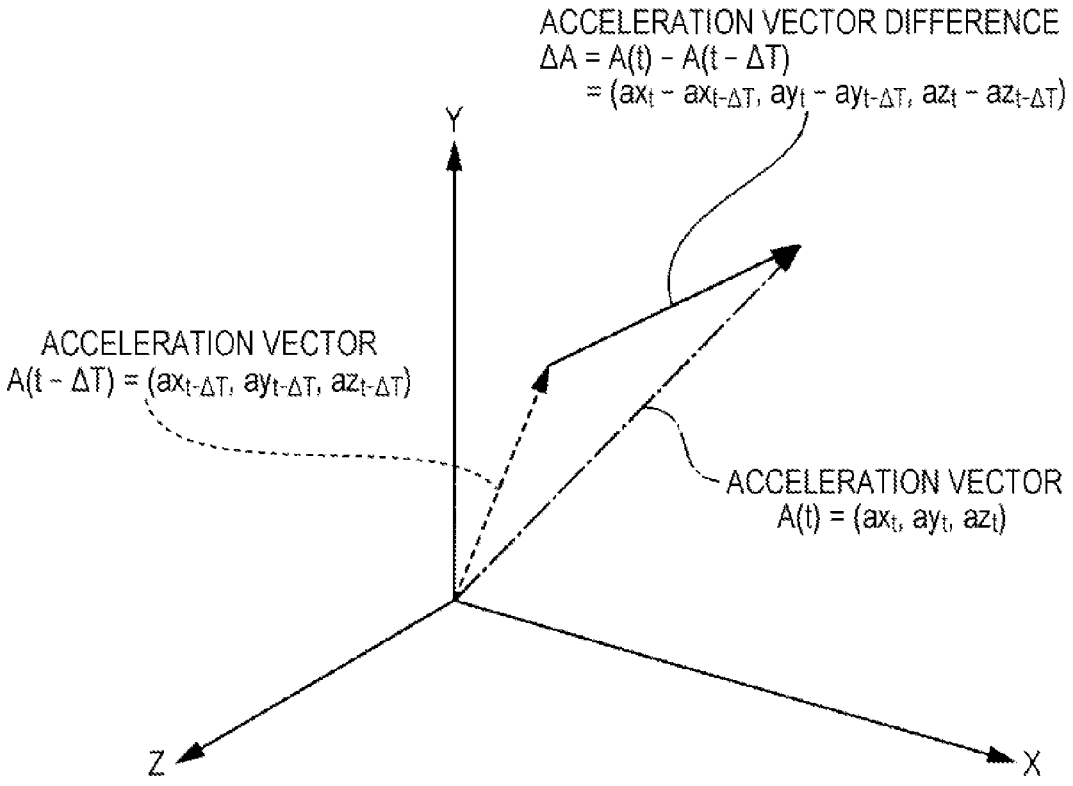
FIG. 2 is a diagram illustrating an example of a difference in acceleration vectors according to an embodiment of the present application.

The input data computation section 21 employs the acceleration detected by the tri -axial accelerometer 14 in each of the axial directions of the K axis, the Y axis, and the Z axis to compute a vector (acceleration vector) of acceleration A in three-dimensional space. Then, a norm u of a difference (acceleration vector difference) ΔA between the acceleration vector A at two difference timings with a time interval of, for example, a sampling period ΔT, is computed as input data to be input to the frequency analyzer As illustrated in FIG. 2, the input data computation section 21 computes, for example, an acceleration vector difference $\Delta A = A(t) - A(t-\Delta T)$ from an acceleration vector $A(t) = (ax_t, ay_t, az_t)$ at a given time t, and an acceleration vector $A(t-\Delta T) = A(t-\Delta t) = (ax_{t-\Delta t} - ay_{t-\Delta t} - ax_{t-\Delta t})$ at time $t-\Delta T$, this being the sampling period ΔT prior to time t. As shown in the Equation (1) below, a norm $u_t$ is computed for acceleration vector difference ΔA.

Note that the buffer size of a buffer (omitted from illustration in the drawings) capable of storing acceleration information for the axial directions of each axis out of the x-axis, the y-axis, and the z-axis detected by the tri-axial accelerometer 14, namely, the acceleration information sample count, are appropriately settable by an operator by, for example, using an appropriate setting screen or the like displayed on the display device 16.

$$u_t = \sqrt{(ax_t - ax_{t-\Delta T})^2 + (ay_t - ay_{t-\Delta T})^2 + (az_t - az_{t-\Delta T})^2} \quad (1)$$

The frequency analyzer 22 performs frequency analysis on input data computed by the input data computation section 21, and computes a power spectrum corresponding to the frequency (acceleration spectrum).

For example, the frequency analyzer 22 uses the number of input/output points and the autocorrelation lag of input data for frequency analysis to compute the autocorrelation of the input data. An acceleration spectrum is computed by performing fast Fourier transform on the autocorrelation. The number of input/output points and autocorrelation lag of input data for frequency analysis, and a selection as to whether or not to subtract an average value from input values of the autocorrelation, are settable by an operator by using, for example, an appropriate setting screen or the like displayed an the display device 16.

For example, the frequency analyzer 22 computes the acceleration spectrum at a specific period of time by computing the autocorrelation in the number of input/output points of the input data computed by the input data computation section 21 at sampling periods ΔT, and performing fast Fourier transform thereon.

The simple linear regression line computation section 23 computes a simple linear regression line in a specific frequency region of the acceleration spectrum computed by the frequency analyzer 22, and converts the slope of the simple linear regression line into information indicating an angle (spectral angle).

Figure 3:
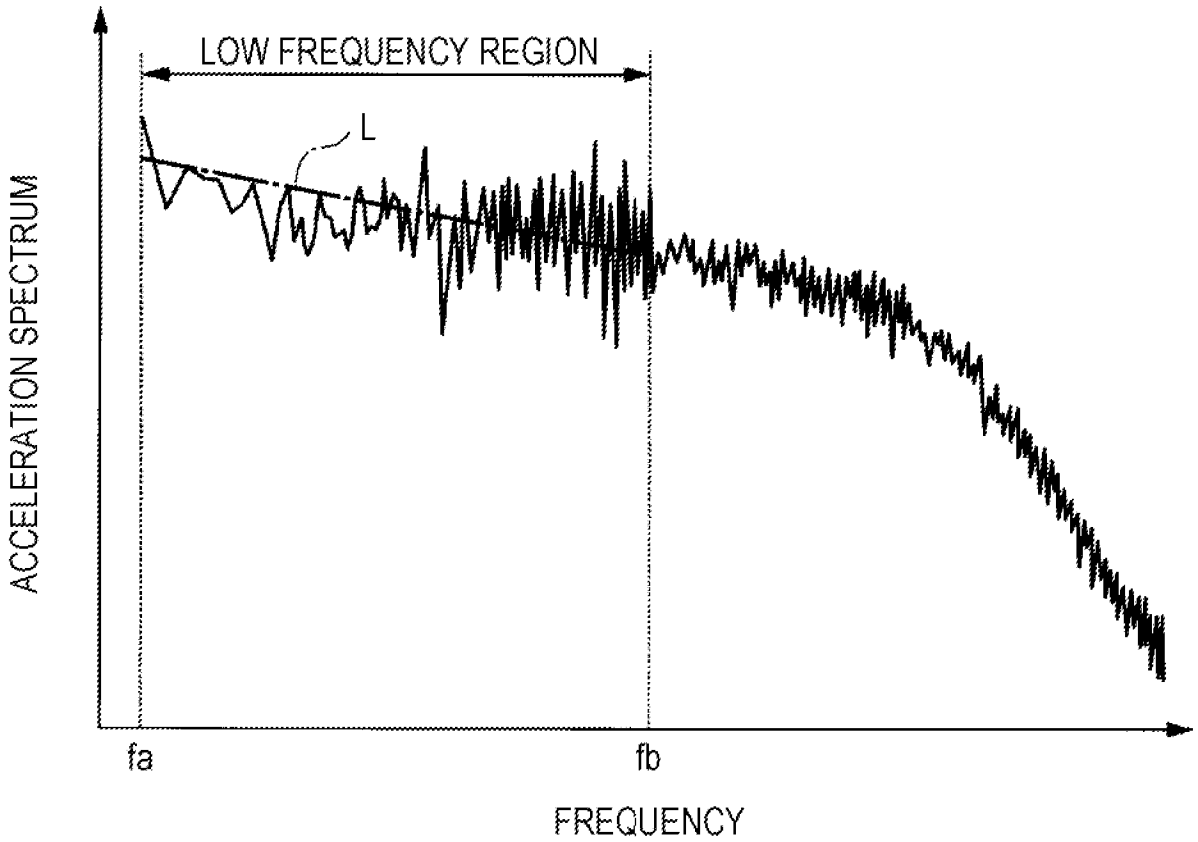
FIG. 3 is a diagram illustrating an example of an acceleration spectrum according to an embodiment of the present application.

For example, in chaos theory, a low frequency power spectrum has a greater impact on a congestion prediction than a high frequency power spectrum. Thus, as illustrated in FIG. 3, the simple linear regression line computation section 23 computes the simple linear regression line L using the least squares method on the acceleration spectrum in a low frequency region of a specific frequency fb and below (for example, a frequency region between a lower limit frequency fa and the specific frequency fb). The simple linear regression computation section 23 the converts the slope of the computed simple linear regression line L (namely, the slope relative to the frequency axis., taking the slope of the axis to be zero) into information indicating an angle (spectral angle) θ.

For example, as the spectral angle θ becomes increasingly negative (the direction of decreasing acceleration spectrum) (namely, as the absolute value increases while the sign is minus), the delay in the dynamic time response of acceleration and deceleration changes so as to tend to increase, and the variation in speed increases. It is accordingly difficult to limit the driving region to prioritize vehicle energy efficiency (such as fuel consumption or power consumption), and the energy efficiency decreases as congestion becomes more liable to occur.

For example, cases where the absolute value of the spectral angle θ is small correspond to cases where the shock wave (oscillation, fluctuation) that the vehicle moving with the driving assistance device 10 receives from the vehicle ahead is small, and correspond to cases where the delay in responding to the vehicle ahead is small, in which coordinated driving with a weak influence on traffic flow is easily achieved. Namely cases where there is a small likelihood of reaching congestion.

In contrast thereto, cases where the absolute value of the spectral angle θ is large correspond to cases where the shock wave (oscillation, fluctuation) that the vehicle moving with the driving assistance device 10 receives from the vehicle ahead is large, and correspond to cases where the delay in responding to the vehicle ahead is large, in which coordinated driving becomes difficult and traffic flow is easily influenced. Namely cases where there is a large likelihood of reaching congestion. The shock wave (oscillation, fluctuation) referred to here means the propagation of actions (front-rear movement) to vehicles behind, like a type of oscillation, due to vehicles repeatedly performing acceleration and deceleration actions.

The determination data computation section 24 uses the angle information computed by the simple linear regression line computation section 23 to compute information representing the change in the angle with time (for example, information indicating the continuous time over which the angle value is maintained, or information indicating the convergence time required to converge the absolute value of the angle to zero), a determination data for input to the congestion prediction section 25.

The determination data computation section 2A, for example as shown by the Equation (2) below, computes determination data $S_N$ from determination segment N (where N is a natural number) and an angular threshold value $\theta_T$, and from angles $\theta_j$ (where j is a natural number of N or lower) computed by the simple linear regression line computation section 23 for the determination segment N. Note that the determination segment N and the angular threshold value $\theta_T$ are settable by an operator by, for example, using an appropriate setting screen or the like displayed on the display device 16. The determination segment N is a number of points of angle information corresponding to a period of time that is, for example, appropriately settable by an operator, namely, a number of points of angle information computed by the simple linear regression line computation section 23 in this period of time.

For example, the determination data computation section 24 computes determination data $S_N$ for a determination segment N corresponding to a specific period of time based on an angle θj (1≤j≤N) computed by the simple linear regression line computation section 23 for a sampling period ΔT. The angular threshold value $\theta_T$ is a freely selected value settable by an operator, and, for example, is a value other than "−45°" or "−45°" which are generally known as (1/f) fluctuation characteristics.

$$S_N = \sum_{j=1}^{N} \frac{\theta_j}{N\theta_T} \tag{2}$$

The determination data $S_N$ in Equation (2) represents a comparison between the total power of acceleration and deceleration over a specific period of time corresponding to the determination segment N, and a specific threshold value corresponding to a specific angular threshold value $\theta_T$. For example, in cases where the total power exceeds the specific threshold value, congestion becomes more liable to occur, and there is also a fall in the energy efficiency (such as fuel consumption or power consumption).

Figure 4:
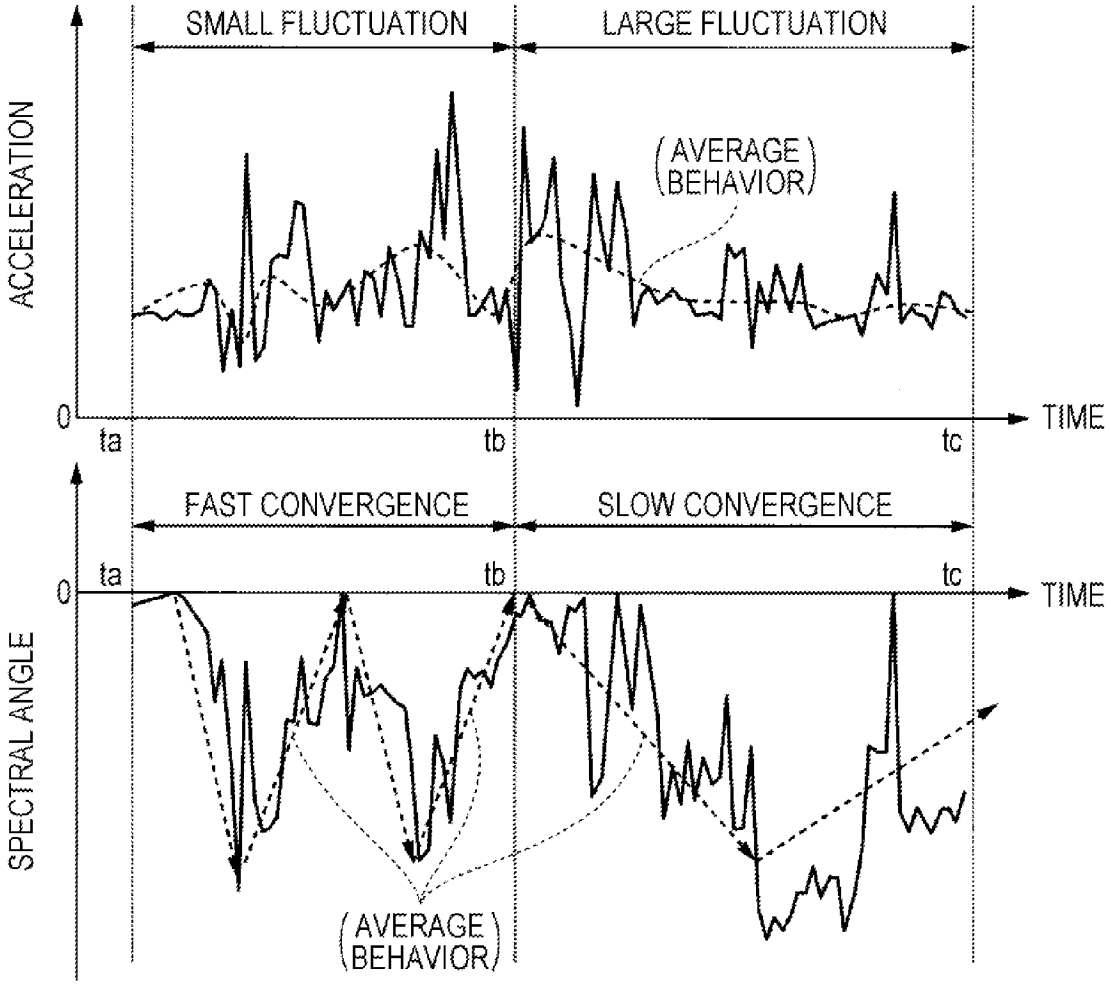
FIG. 4 is a diagram illustrating an example of temporal fluctuations and average behavior of acceleration and spectral angle according to an embodiment of the present application.

For example, fluctuations in the acceleration are small in cases where transition is made by vehicles from a stationary state to a fixed driving speed by appropriate acceleration, as in the acceleration, and fluctuation and average behavior of the spectral angle, over the period from time ta to time tb indicated in FIG. 4. Even if the absolute value of the spectral angle temporarily increases, the total power of the acceleration and deceleration is still a small value due to the rapid convergence to zero.

Moreover, in cases where, for example, there is a fixed driving speed or a gentle deceleration of a vehicle due to engine braking, or the like, as in, for example, the acceleration and fluctuation and average behavior of the spectral angle over the period of time from time ta to time tb illustrated in FIG. 4, the fluctuation in acceleration is still small. Moreover, due to the absolute value of the spectral angle maintaining a small value, the total power of the acceleration and deceleration is a small value. In such cases, even if, for example, the absolute value of the spectral angle temporarily increases due to an oscillation or the like, the total power of the acceleration and deceleration is a small value due to the rapid convergence to zero. Moreover, even if, for example, the absolute value of the spectral angle temporarily increases due to detection error in the tri-axial accelerometer 14, the total power of the acceleration and deceleration is still a small value due to the rapid convergence to zero.

However, the fluctuation in acceleration is large in cases where, for example, a vehicle rapidly decelerates, or decelerates immediately after accelerating, as in the acceleration, and fluctuation and average behavior of the spectral angle, over the period from time tb to time tc indicated in FIG. 4. Moreover, the absolute value of the spectral angle is a large value, and the total power of the acceleration and deceleration is a large value due to a long time being required to converge toward zero.

The congestion prediction section 25 detects a congestion warning sign indicating that there is a possibility of congestion (traffic congestion) occurring in the future, or that there is a possibility congestion is already occurring, according to at least one out of the spectral angle θ computed by the simple linear regression line computation section 23, or the determination data $S_N$ computed by the determination data computation section 24. The congestion warning sign level indicating the extent of the congestion warning sign is high when the possibility is high that congestion will occur in front, in the direction of progression, of the vehicle moving With the driving assistance device 10, and is low when the possibility is low.

The congestion prediction section 25 determine, for example, whether or not the spectral angle θ exceeds the specific angular threshold value $\theta_T$, and also determines whether or not the determination data $S_N$ exceeds a specific determination threshold value (namely, a threshold value for the strength of change in acceleration). In cases where the spectral angle θ exceeds the angular threshold value $\theta_T$ and the determination data $S_N$ exceeds the determination threshold value, determination is made that a situation is occurring in which there is a tendency toward falling vehicle energy efficiency (such as fuel consumption or power consumption), and in which congestion is liable to occur. Note that the specific determination threshold value for the determination data $S_N$ is, for example, settable by an operator using an appropriate setting screen or the like displayed on the display device 16.

For example, the congestion prediction section 25 may derive in advance a function (for example, y=αx+β) expressing a relationship between the magnitude by which the determination data $S_N$ exceeds the determination threshold value (x), and the congestion warning sign level (y). The congestion prediction section 25 is then able to compute the congestion warning sign level (y) for a combination of the determination data $S_N$ computed by the determination data computation section 24, and the determination threshold value.

Moreover, the congestion prediction section 25 may generate in advance a correspondence relationship between determination data $S_N$ and determination threshold values, and corresponding values of congestion warning sign level, and store these as a table. The congestion prediction section 25 is then able to find the congestion warning sign level corresponding to the determination data $S_N$ and the determination threshold value by referring to the table.

The information presentation controller 26 acquires information regarding the travel path of the current position of the driving assistance device 10, and determines, whether or not the driving assistance device 10 is present on a travel path having multiple lanes. The information presentation controller 26 acquires information regarding the travel path from, for example, road map data stored in the map data storage section 10, described below.

The information presentation controller 26 acquires information regarding the number of pace cars contained in a vehicle group present on the travel path within a specific distance range within the periphery of the current position of the driving assistance device 10. The pace cars are, for example, vehicles installed with at least the driving assistance device 10, and are vehicles that can be observed as driving under the driving assistance of the driving assistance device 10. The information presentation controller 26 takes, for example, the number of other vehicles within the specific travel path range capable of communicating by inter-vehicle communication via the communication unit 11 as the number of pace cars. The information presentation controller 26, for example, references pre-stored data or the like based on the speed in the specific travel path range, and the size of the specific travel path range, and ascertains the total number of vehicles present in the specific travel path range. The information presentation controller 26 acquires the proportion of pace cars based on the total number of vehicles and the number of pace cars present in the specific travel path range. The information presentation controller 26 acquires the speed in the specific travel path range from, for example, speedometers of the vehicles installed with the driving assistance device 10. The data pre-stored by the information presentation controller 26 is data expressing correspondence relationships between the size of the specific travel path range, the speed of vehicles in the specific travel path range, and the total number of vehicles present in the specific travel path range.

In cases where the current position of the driving assistance device is present On a travel path having multiple lanes, and the congestion prediction section 25 has determined that a situation exists in which congestion is liable to occur, the information presentation controller 25 controls the display device 16, as to present information indicating that lane change is restricted. The information indicating that lane change is restricted is, for example, information indicating that lane change is prohibited.

In cases where the current position of the driving assistance device 10 is present on a travel path having multiple lanes, and the congestion prediction section 25 has not determined that a situation exists in which congestion is liable to occur, the information presentation controller 26 controls the display device 16 so as to present information indicating that lane change is non-restricted. The information indicating that lane change is non-restricted is, for example, information indicating that lane change is permitted, or information negating a prohibition on lane change.

The information presentation controller 26 causes the display device 16 to display information indicating either restriction or non-restriction of lane change using, for example, a specific icon or text data with a specific phrase, such as on a meter panel disposed in an instrument panel (not illustrated in the drawings). The information presentation on the display device 16 is, for example, performed by an appropriate display operation, such as continuous or intermittent, display.

The information presentation controller 26 may change the operational content of presentation according to the proportion of pace cars in the specific travel path range when information is presented to indicate lane change is restricted or non-restricted. The information presentation controller 26, for example, intervenes less by information presentation when there is a high proportion of pace cars, and intervenes more when there is a low proportion of pace cars. The information presentation controller 26, for example, increases or decreases the extent of intervention by information presentation by changing the execution frequency of information presentation, or by changing the forcefulness of the way in which information presentation is performed. Since the regularity of traffic flow in multiple lanes increases as the proportion of pace cars increases, the information presentation controller 26, for example, raises the degree to which lane change is restricted or lowers the degree to which lane change is non-restricted. However, the information presentation controller 26 need not raise the degree to which lane change is restricted compared to cases where there is a high proportion of pace cars, since, although the regularity of traffic flow in multiple lanes decreases as the proportion of pace cars decreases, the influence of lane changes by pace cars on other also sometimes smaller.

The information presentation controller 26, for example, divides the proportion of pace cars into multiple levels (for example, three levels) by using multiple pre-set threshold values for the proportion of pace cars, and changes the degree to which lane change is restricted or non-restricted according to each level. The information presentation controller 26, for example, adopts a state with the lowest degree of lane change restriction when the proportion of pace cars is less than a first threshold value. The information presentation controller 26, for example, employs the lowest frequency of information presentation indicating lane change restriction, or presents the information indicating lane change restriction in the least forceful manner. The information presentation controller 26, for example, adopts a state with the highest degree of lane change restriction when the proportion of pace cars is equal to, or greater than, a second threshold value that is higher than the first threshold value. The information presentation controller 26, for example, employs the highest frequency of information presentation indicating lane change restriction, or presents the information indicating lane change restriction in the most forceful Manner. The information presentation controller 26, for example, adopts an intermediate degree of lane change restriction When the proportion of pace cars is the first threshold Value or greater, but less than the second threshold value.

The information presentation controller 26 may control the display device 16 so as to present information prompting a change that tends to reduce the inter-vehicle distance or inter-vehicle time when presenting information indicating lane change restriction. The information presentation controller 26 causes the display device 15 to display information prompting a change that tends to reduce the inter-vehicle distance or inter-vehicle time by, for example, displaying a specific icon or text data with a specific phrase. The information presentation controller 26, for example, causes the display device 15 to display the degree of decrease in inter-vehicle distance or inter-vehicle time by using a specific numerical target indicating the extent of decrease in inter-vehicle distance or inter vehicle time (such as a percentage decrease from the current state), by the forcefulness in the tone of the phrase, or by categories of shape and color of the icon. The information presentation controller 26 may change the degree of decrease in inter-vehicle distance or inter-vehicle time according to the degree of lane change restriction, or according to the proportion of pace cars in the specific travel path range.

The information presentation controller 26 may present information indicating a recommendation to lane change as the information indicating non-restriction of lane change when information has been acquired indicating a recommendation to travel in another lane, based on road information or traffic information. The information presentation controller 26, for example, determines that information has been acquired to indicate a recommendation to travel in another lane in cases such as those in which, based on road information, a disparity has been detected between the legal speed limit or the past average effective vehicle speed, and the actual speed, and presents the information indicating a recommendation to change lanes. The information presentation controller 26, for example, determines that information has been acquired to indicate a recommendation to travel in another lane in cases such as those in which it has been ascertained, based on traffic information, that travelling restrictions are in force due to road works or an accident in the lane, and then presents information indicating a recommendation to change lanes. The information presentation controller 26, for example, acquires road information from road map data stored in a map data storage section 18, described below. The information presentation controller 26, for example, acquires traffic information through inter-vehicle communication using the communication unit 11, by data broadcast using a broadcast receiver (not illustrated in the drawings), or the like, The map data storage section 18 stores the map data.

The map data includes, for example, road coordinate data indicating coordinates on a road necessary for map matching processing to be performed based on the information indicating the current position of the driving assistance device 10, and road map data necessary to compute a guided route. The road map data includes, for example, nodes, links, link costs, road shape, road states such as the presence or absence of paving, the presence or absence of undulations in the road surface, and vehicle travel state, and a road category. Nodes are coordinate points of the longitude and latitude of specific ground points on roads of crossings, junctions, and the like. Links are lines connecting respective nodes, and are road segments that connect ground points together. The link cost is information indicating the length of the road segment, or the travel time required to move along the road segment, corresponding to the link.

The driving assistance device 10 implementing the driving assistance method of the present embodiment includes the configuration described above. Next, explanation follows regarding operation of the driving assistance device 10, namely, regarding the driving assistance method.

First, at step S01 of FIG. SA, the device controller 17 determines whether or not the tri-axial accelerometer 14 has detected acceleration in each axial direction of the X axis, the Y axis, and the Z axis.

The device controller 17 repeats execution of the determination processing step S01 when the determination result is "NO".

However, the device controller 17 advances processing to step S02 when the determination result is "YES".

Next, at step S02, the input data computation section 21 computes the acceleration vector A in three-dimensional space using the acceleration in each axial direction of the X axis, the Y axis, and the Z axis detected by the tri-axial accelerometer 14. The input data computation section 21 then computes as input data a norm u of a difference (acceleration vector difference) $\Delta A$ in the acceleration vector A at two different timings at a time interval of sampling period $\Delta T$.

Next, at step S03, the frequency analyzer 22 uses a lag settable by an operator to compute autocorrelation of input data in a number of input/output points settable by the operator. The frequency analyzer 22 then computes a power spectrum (acceleration spectrum) by fast Fourier transform on the autocorrelation.

Next, at step S04, the simple linear regression line computation section 23 computes a simple linear regression line in the specific frequency range of the acceleration spectrum, and converts the slope of the simple linear regression line into an angle (spectral angle) $\theta$.

Next, at step S05, the congestion prediction section 25 determines whether or not the spectral angle $\theta$ has exceeded the angular threshold value $\theta_T$.

The congestion prediction section 25 advances processing to step S06 when the determination result is "YES".

However, the congestion prediction section 25 advances processing to step S07 when the determination result is "NO".

Then at step S06, the congestion prediction section 25 sets "1" for a flag value of an angular threshold value flag to indicate that the spectral angle $\theta$ has exceeded the angular threshold value $\theta_T$.

At step S07, the congest on prediction section 25 sets "0" for the flag value of the angular threshold value flag to indicate that the spectral angle $\theta$ has not exceeded the angular threshold value $\theta_T$.

The at step S08, the congestion prediction section 25 uses the information the spectral angle $\theta$ to compute the determination data $S_N$ represented by above Equation (2) as the information indicating a change in Spectral angle $\theta$ with time.

Figure 5A:
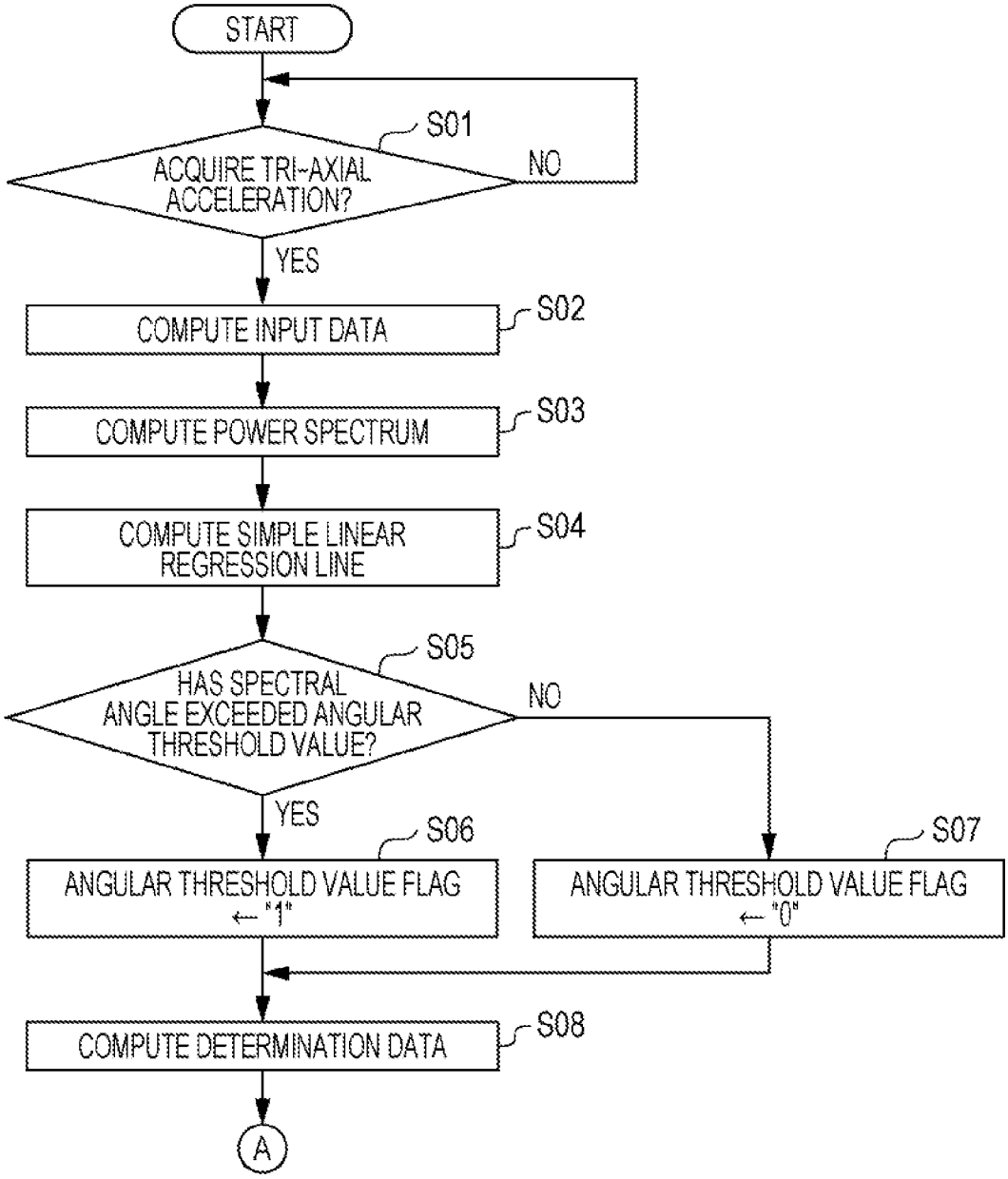
FIG. 5A and FIG. 5B are a flowchart illustrating a driving assistance method according to an embodiment of the present application.
Figure 5B:
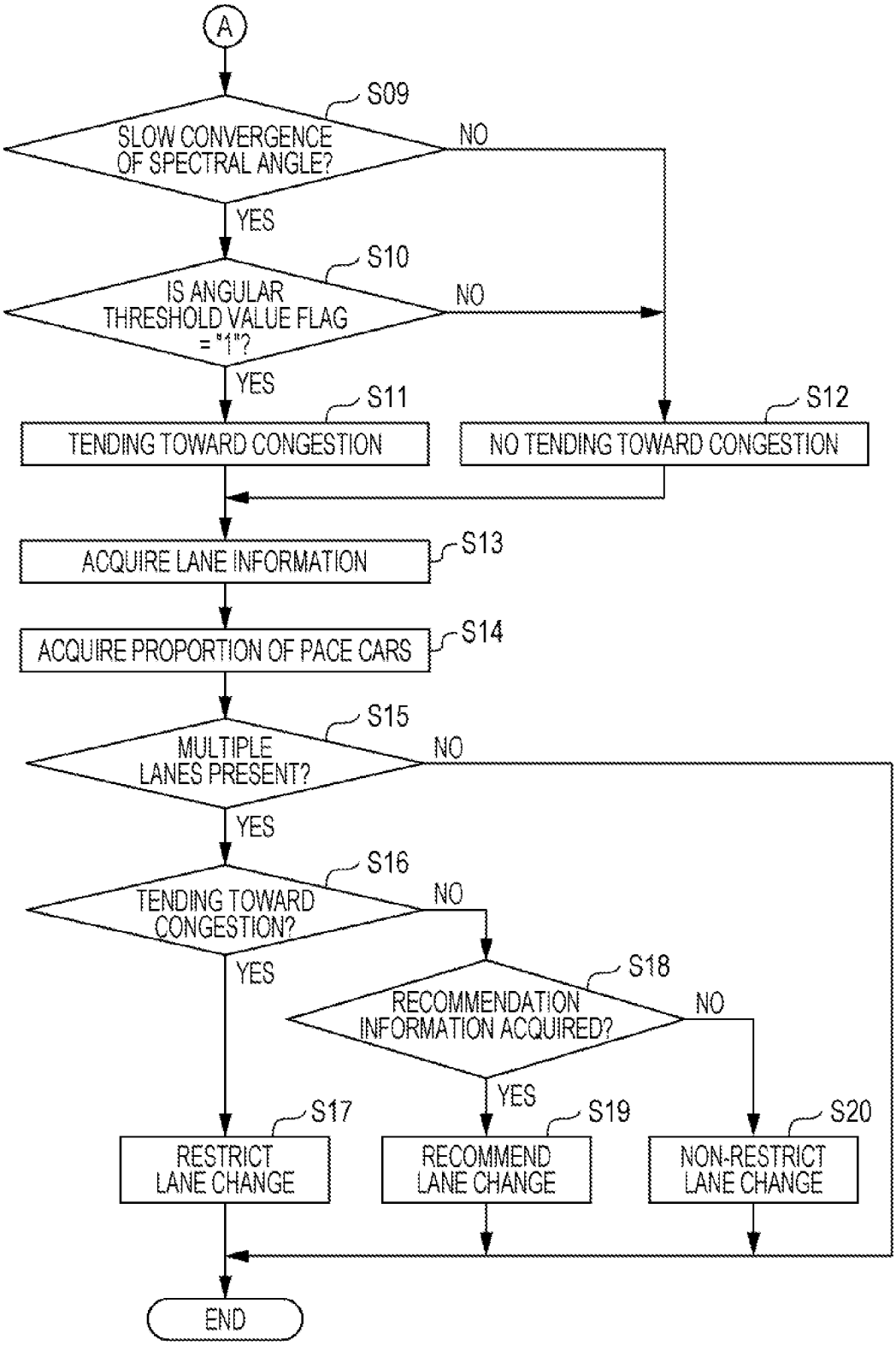

Next, at step S09 of FIG. 5B, the congestion prediction section 25 determines whether or not convergence of the spectral angle $\theta$ toward zero is slow by, for example, determining whether or not the determination data $S_N$ has exceeded the determination threshold value (namely, the threshold value for the strength of acceleration change).

The congestion prediction section 25 advances processing to step S12 when the determination result is "NO".

However, the congestion prediction section 25 advances processing to step S10 when the determination result is "YES".

Then at step S10, the congestion prediction section 25 determines whether or not the flag value of the angular threshold value flag has been set to "1".

The congestion prediction section 25 advances processing to step S12 when the determination result of step S10 is "NO".

However, the congestion prediction section 25 advances processing to step S11 when the determination result of step S10 is "YES".

Then at step S11, the congestion prediction section 25 determines that the situation is such that congestion is liable to occur, namely, a state indicating change in traffic flow tending toward congestion. Then, the congestion prediction section 25 advances processing to step S13.

At step S12, the congestion prediction section 25 determines that the situation is such that congestion is not liable to occur, namely, a state not indicating change in traffic flow tending toward congestion. Then the congestion prediction section 25 advances processing to step S13.

Next, at step S13, the information presentation controller 26 acquires information regarding the travel path of the current position of the driving assistance device 10.

Next, at step S14, the information presentation controller 26 acquires information regarding proportion of pace cars contained in the vehicle group present on the travel path in a specific distance range in the periphery of the current position of the driving assistance device 10.

Next, at step S15, the information presentation controller 26 determines whether or not the current position of the driving assistance device 10 is on a travel path of multiple lanes.

The information presentation controller 26 advances processing to the end when this determination result is "NO".

However, the information presentation controller 26 advances processing to stop S16 when this determination result is "YES".

Then At step S16, the information presentation controller 26 determines whether or not it has been determined by the congestion prediction section 25 that the situation is such that congestion is liable to occur.

The congestion prediction section 25 advances processing to step S18 when the determination result at step S16 is "NO".

However, the congestion prediction section 25 advances processing to step S17 when the determination result at step S16 is "YES".

Next, at step S17, the information presentation controller 26 controls the display device 16 so as present information indicating that lane change is restricted. Then the information presentation controller 26 advances processing to the end.

At step S18, the information presentation controller 26 determines whether or not, based on road information or traffic information, information indicating a recommendation to travel in another lane has been acquired.

The information presentation controller 26 advances processing to step S20 when this determination result is "NO".

However, the information presentation controller 26 advances processing to step S19 when the determination result is "YES".

Next, at step S19, the information presentation controller 26 controls the display device 16 so as to present information indicating a recommendation to change lanes. Then the information presentation controller 26 advances processing to the end.

Next, at step S20, the information presentation controller 26 controls the display device 16 so as to present information indicating that lane change is non-restricted. The information presentation controller 26 then advances processing to the end.

As stated above, the driving assistance device 10 and the driving assistance method of the present embodiment enable disruption to traffic flow to be reduced by restricting lane changes based on congestion warning sign information. Moreover, due to raising the congestion suppressing effect, an appropriate balance can he achieved in multi-lane traffic flow between a direct reduction in speed accompanying lane changes, and recovery of the average speed. Although there is the possibility that the average speed decreases due to inter-vehicle propagation of speed reduction in the lane that a vehicle changing lanes is moving into, an increase in the average speed of overall traffic flow across multiple lanes can be achieved by appropriately dispersing vehicles that are disproportionately distributed in a particular lane, to another lane. The inter-vehicle time can be shortened by lane change restriction based on the congestion warning sign level. Due to being able to achieve lane change restricted travel, a chain reaction of lane changes can be prevented from occurring, enabling an improvement in the stability of traffic flow.

Moreover, when congestion prediction information does not indicate a change tending toward congestion of traffic flow, presenting non-restriction of lane changes promotes dispersion of traffic volumes over multiple lanes, enabling congestion to be suppressed from occurring.

Moreover, due to the operational content of information presentation being changed according to the proportion of pace cars, information can be effectively presented to restrict or non-restrict lane changes, while also appropriately corresponding to various traffic flow states.

Moreover, in cases where the congestion warning sign level indicates traffic flow tending toward congestion, and there is a possibility that the average speed of a lane falls due to lane changes, traffic volume within each lane is dispersed by reducing the inter-vehicle distance or inter-vehicle time while also restricting lane changes, enabling congestion to be suppressed from occurring.

Moreover, in cases where, based on road information, there is a disparity between the legal speed limit or the past average effective vehicle speed, and the actual speed, and the traffic flow overall average speed across multiple lanes can be increased by recommending lane changes, enabling congestion to be suppressed from occurring. Moreover, by recommending lane changes in cases such as those in which it is ascertained, based on traffic information, that a speed limit is in force due to road works, an accident, or the like in the lane, dispersion of vehicles across all of multiple lanes can be promoted, and congestion can be suppressed from occurring.

Figure 6:
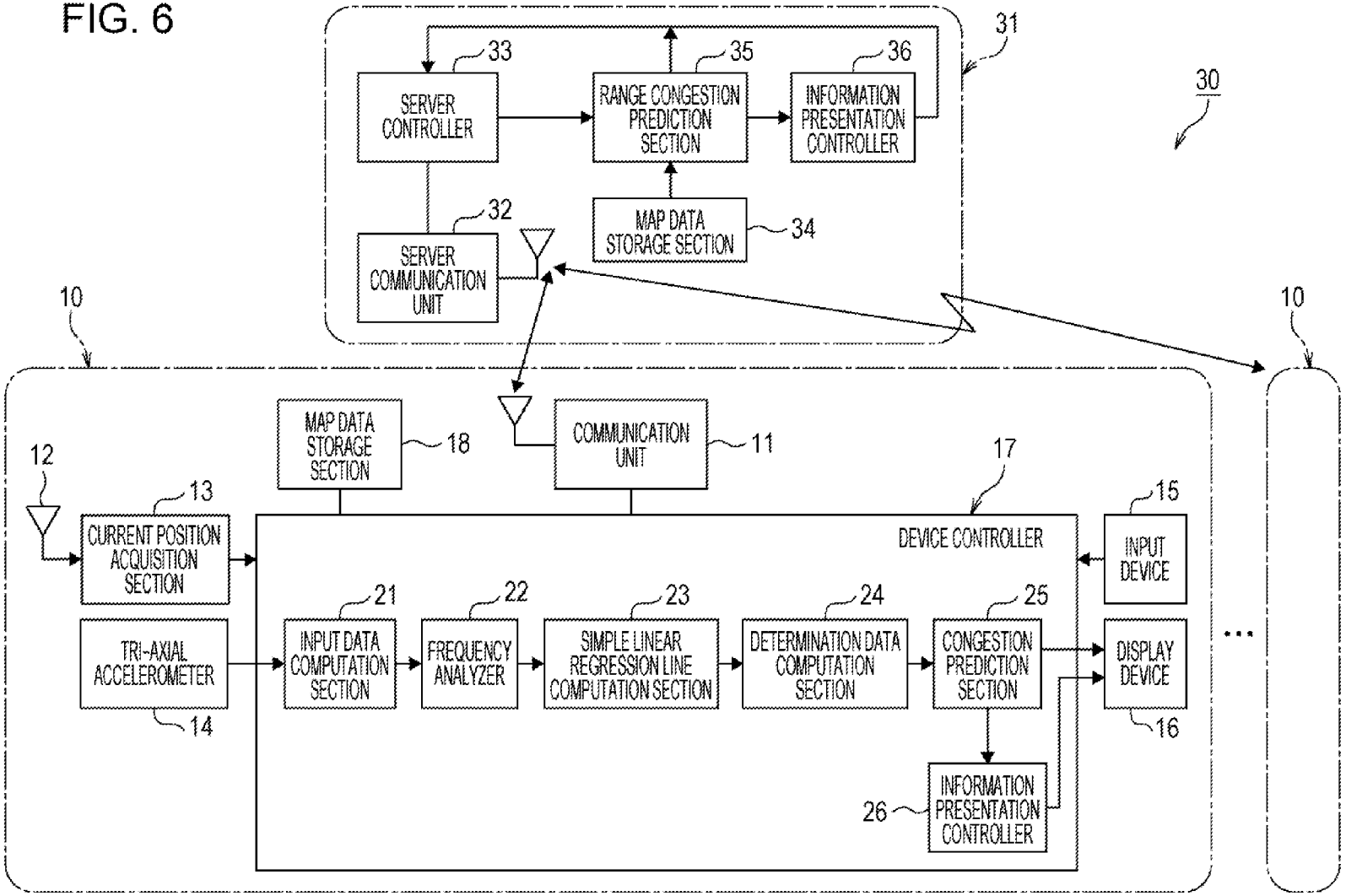
FIG. 6 is a configuration diagram of a driving assistance system that implements a driving assistance method according to a modified example of an embodiment of the present application.

In the embodiment described above, a driving assistance system 30 may, for example as in the modified example illustrated in FIG. 6, be configured to include at least one or more driving assistance device 10, and a server device 31 capable of communicating with the driving assistance device 10.

The server device 31 in such a modified example includes a server communication unit 32, a server controller 33, a map data storage section 34, a range congestion prediction section 35, and an information presentation controller 36.

The server communication unit 32 is, for example, capable of two-way communication with the communication unit 11 of the driving assistance device 10 by wireless communication in an infrastructure mode, or by roadside-to-vehicle communication through a roadside communication and transmits receives various information.

The server controller 33 use the server cation unit 32 to output various information received from the driving assistance device 10 to the range gong prediction section 35.

This modified example of the driving assistance device 10 is capable of transmitting to the server device 31 information based on the acceleration in each axial direction of the X axis, the Y axis, and the Z axis detected by the tri-axial accelerometer 14. This information includes, for example, information regarding the spectral angle θ computed by the simple linear regression line computation section 23, the determination data $S_N$ computed by the determination data computation section 24, and the congestion warning sign level computed by the congestion prediction section 25. This information also includes a history of the current positions acquired by the current position acquisition section 13 information (probe data) indicating is history of speeds detected by a vehicle speedometer installed in the driving assistance device 10, and the like.

The map data storage section 34 stores the map data.

The map data includes, for example, road coordinate data indicating position coordinates on a road necessary for map matching processing to be performed based on the information indicating the current position of the driving assistance device 10, and road map data necessary to compute a guided route. The road map data includes, for example, nodes, links, link costs, road shape, road states such as the presence or absence of paving, the presence or absence of undulations in the road surface, and vehicle travel state, and a road category. Nodes are coordinate points of the longitude and latitude of specific ground points on roads of crossings, junctions, and the like. Links are lines connecting respective nodes, and are road segments that connect ground points together. The link cost is information indicating the length of the road segment, or the travel time required to move along the road segment, corresponding to the link.

For an appropriate positional range based on information of the current position received from the at least one or more driving assistance devices 10, the range congestion prediction section 35, for example, detects a congestion warning sign within the positional range, based on a number or a proportion of the driving assistance devices 10, in which the spectral angle θ, the determination data $S_N$, a congestion warning sign level, or the like, received from the driving assistance device 10, is a specific threshold value or greater.

The information presentation controller 36 executes at least part of the processing executed by the information presentation controller 26 in the at least one or more driving assistance devices 10 of the embodiment described above.

The information presentation controller 36 acquires information regarding the travel path within a specific distance range (within a specific travel path range) in the periphery of the current position received from the at least one or more driving assistance devices 10, and determines whether or not the driving assistance devices 10 are present on a travel path of multiple lanes. The information presentation controller 26 acquires the information regarding the travel path from, for example, road map data stored in the map data storage section 34.

The information presentation controller 36 acquires information regarding the proportion of pace cars contained in the vehicle group present on the travel path in a specific distance range in the periphery of the current position received from the at least one or more driving assistance devices 10. The information presentation controller 36 estimates, for example, the proportion of pace cars present within the specific travel path range based on information indicating the history of the current position and speed received from the at least one or more driving assistance devices 10, statistical information accumulated up to the current time, or the like. The statistical information is, for example, information such as the number of vehicles travelling, and the number of pace cars, statistically accumulated according to date, day, and time band for each specific range of the travel path.

The information presentation controller 36 presents, to each of the driving assistance devices 10, information indicating lane change restriction when the range congestion prediction section 35 has determined that the current position of each of the driving assistance devices 10 is on a travel path of multiple lanes, and the situation is such that congestion is liable to occur.

The information presentation controller 26 presents, to each of the driving assistance devices 10, information indicating lane changes are non-restricted when the range congestion prediction section 35 has not determined that the current position of each of the driving assistance devices 10 is on a travel path of multiple lanes and the situation is such that congestion is liable to occur.

When information being presented to indicate lane change is restricted or non-restricted in each of the driving assistance devices 10, the information presentation controller 36 may change the operational content of the presentation according to the proportion of pace cars in the specific travel path range. The information presentation controller 36, for example, increases the extent of intervention through information presentation by changing the number of the driving assistance devices 10 executing the information presentation, or changing the forcefulness in the manner of information presentation by the driving assistance devices 10.

The information presentation controller 36 may, for example, divide the proportion of pace cars into multiple levels, and control more precisely than in cases where the information presentation controller 26 of each of the driving assistance devices 10 switches the degree to which lane changes are restricted or non-restricted according to each level. The information presentation controller 36 may control more precisely by, for example, dividing the proportion of pace cars into even more levels, or by more precisely switching the degree to which lane changes are restricted or non-restricted.

The information presentation controller 36 may present information regarding the proportion of pace cars in the specific travel path range to each of each of the driving assistance devices 10.

The information presentation controller 36 may control so as to present the same information to all the driving assistance devices 10 within the specific travel path range when presenting information to prompt a change that tends to reduce the inter-vehicle distance or inter-vehicle time together with the information indicating lane change restriction in each of the driving assistance devices 10. The information presentation controller 36 may, for example, employ the same specific numerical target indicating the degree of decrease in inter-vehicle distance or inter-vehicle time (such as a percentage decrease from the current state), the same forcefulness in the tone of the phrase, or the same categories of shape and color of the icon, to plural of the driving assistance devices 10.

The information presentation controller 36 may present information indicating a recommendation to travel in another lane to each of the driving assistance devices 10 in cases where specific road information or traffic information has been acquired for a travel path in a specific distance range in the periphery of the current position received from the at least one or more driving assistance devices 10. The specific road information may, for example, be information indicating that there is a specific disparity or greater between the legal speed limit or past average effective vehicle speeds collected by probe data or the like, and the current speed of each of the driving assistance devices 10. The specific traffic information is, for example, information indicating that a speed limit is in force due to road works, an accident, or the like in the lane. The information presentation controller 36 may present, to each of the driving assistance devices 10, specific road information or traffic information, or information indicating a recommendation to travel in another lane based on road information or traffic information.

In cases where the lane of each of the driving assistance devices 10 can be confirmed based on information indicating the current position or the like received from each of the driving assistance devices 10, the information presentation controller 36 may, present road information or traffic information, or information indicating a recommendation to travel in another lane based on road information or traffic information, that differs for each lane.

Next, explanation follows regarding operation of the driving assistance system 30, and in particular operation of the driving assistance device 10, in the driving assistance system 30 that implements the driving assistance method of this modified example, and that is provided with the configuration described above.

Figure 7:
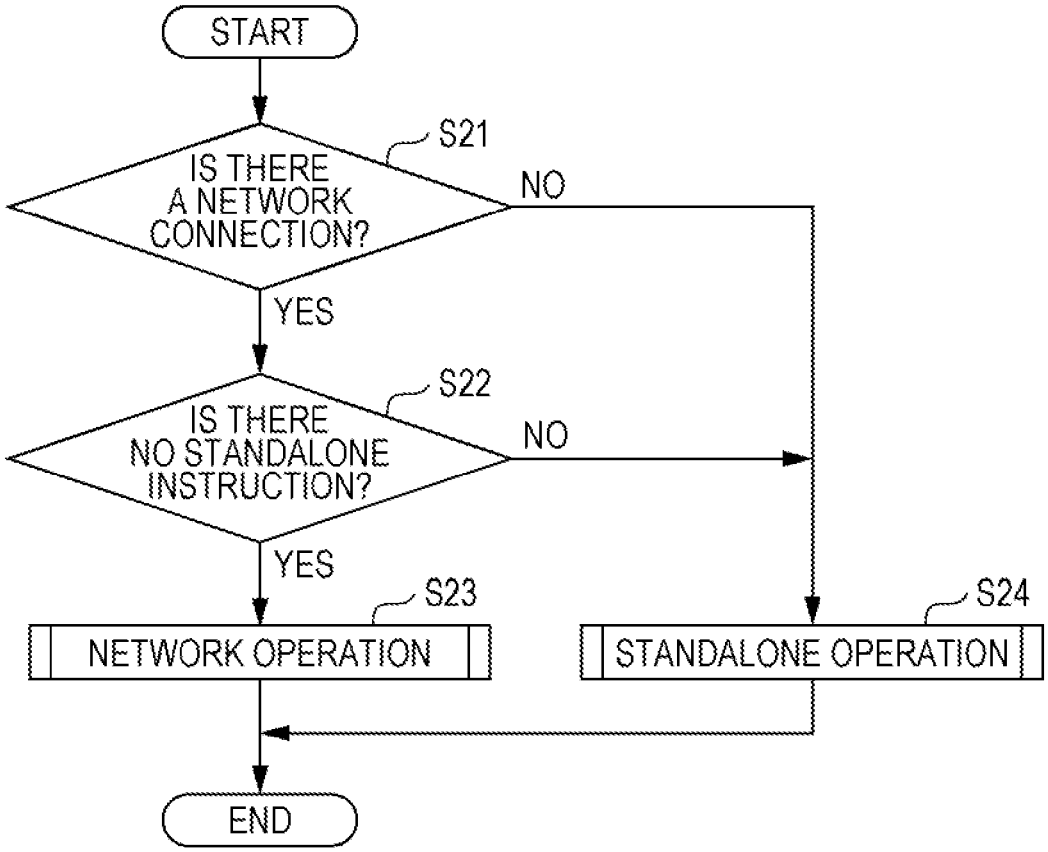
FIG. 7 is a flowchart illustrating a driving assistance method according to a modified example of an embodiment of the present application.

First, at step S21 illustrated in FIG. 7, the server controller 33 determines whether or not the driving assistance device 10 is connected to a communication network, such as a wireless communication network system, and can correctly connect over the communication network to the server device 31, without any communication problems or the like.

The server controller 33 repeats execution of the processing of step S21 when the determination result is "NO".

However, the server controller 33 advances processing to step S22 when this determination result is "YES".

At step S22, the server controller 33 determines whether or not an instruction has not been issued to execute standalone operation independent of an external device such as the server device 31, such as by an instruction from an operator.

The server controller 33 advances processing to step S23 when the determination is "YES", namely, when there is no standalone operation execution instruction At step S23, the server controller 33 executes network operation, described below, and ends the processing.

However, the server controller 33 advances processing to step S24 when the determination result is "NO". At step S24, the server controller 33 executes the processing in the above embodiment from step S01 to step S20 as the standalone operation.

Explanation follows regarding the network operation at above step S23.

Figure 8:
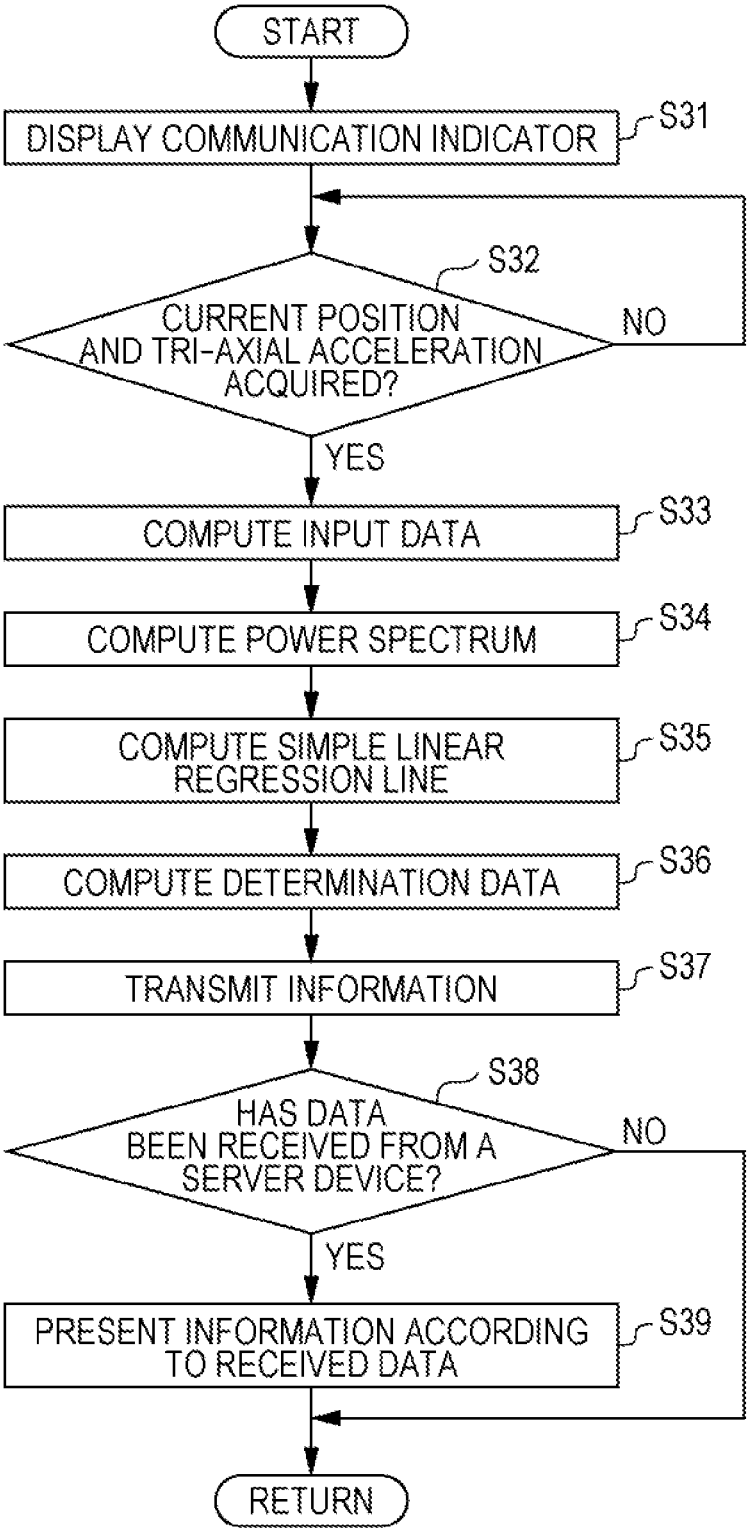
FIG. 8 is a flowchart illustrating network operation illustrated in FIG. 7.

First, at step S31 illustrated in FIG. 8, the device controller 17 displays a specific communication indicator display on the display device 16. The device controller 17 displays a communication indicator to indicate that the driving assistance device 10 is connected to a communication network, such as a wireless communication network system, and can correctly connect to server device 31 over the communication network without any communication problems or the like.

Next, at step S32, the device controller 17 determines whether or not the acceleration in each axial direction of the X axis, the Y axis, and the Z axis has been detected using the tri-axial accelerometer 14, and information indicating the current position has been acquired using the current position acquisition section 13.

The device controller 17 repeats execution of the determination processing of step S32 when the determination result is "NO".

However, the device controller 17 advances processing to step S33 when this determination result is "YES".

Next at step S33, the input data computation section 21 employs the accelerations each axial direction of the X axis, the Y axis, And the Z axis detected using the tri-axial accelerometer 14 to compute the acceleration vector A in three-dimensional space. The input data computation section 21 then computes, as input data, the norm u of the difference (acceleration vector difference) $\Delta A$ in the acceleration vector A at two different timings at a time interval of sampling period $\Delta T$.

Next, at step S34, the frequency analyzer 22 uses a lag appropriately settable by an operator to compute the autocorrelation of the input data in a number of input/output points appropriately settable by an operator. The frequency analyzer 22 then computes the power spectrum (acceleration spectrum) by performing a fast Fourier transform on the autocorrelation.

Next, at step S35, the simple linear regression line computation section 23 computes a simple linear regression line over a specific frequency range of the acceleration spectrum, and converts the slope of the simple linear regression line into information indicating an angle (spectral angle) $\theta$.

Next, at step S36, the congestion prediction section 25 employs the information indicating the spectral angle $\theta$, to compute the determination data $S_N$ expressed by above Equation (2) as information expressing a change in the spectral angle $\theta$ with time.

Next, at step S37, the device controller 17 uses toe communication unit 11 to transmit, to the server device 31, information regarding the spectral angle $\theta$, the determination data $S_N$, the congestion warning sign level computed by the congestion prediction section 25, and information indicating the current position, and the like.

Next, at step S38, the device controller 17 determines whether or not the information regarding the congestion warning signs within an appropriate positional range detected by the server device 31, the information expressing lane change restriction or non-restriction, the specific road information or traffic information, and the like have been received from the server device 31.

The device controller 17 ends the processing series when the determination result is "NO".

However, the device controller 17 advances processing to step S39 when the determination result is "YES".

Next, at step S39, the device controller 17 controls the display device 16 so as to present the information expressing lane change restriction or non-restriction output from the information presentation controller 26 based on the information expressing lane change restriction or non-restriction received from the server device 31, or based on various data received from the server device 31. The device controller 17 then advances processing to the return point.

The driving assistance system 30 and driving assistance method according to the modified example enable information based on the acceleration to be acquired from plural driving assistance devices 10, and for information expressing lane change restriction or non-restriction to be presented in an integrated manner in real time. This thereby enables computation efficiency to be raised, and enables efficient control to suppress or eliminate the occurrence of congestion by coordinating plural driving assistance devices 10, compared to cases where, for example, the congestion warning sign level is computed and information of lane change restriction or non-restriction presented in each of the driving assistance devices 10.

In the driving assistance device 10 according to the above embodiment, the information presentation controller 26 is configured to acquire information from road map data stored in the map data storage section 18 regarding whether or not the travel path has multiple lanes, however there is no limitation thereto.

In the modified example of the embodiment, the driving assistance device 10 may acquire information regarding whether or not the travel path has multiple lanes based on image data of the outside world captured a camera provided to the vehicle installed with the driving assistance device 10.

In the driving assistance device 10 according to the above embodiment, the pace cars serve as the vehicles installed with at least the driving assistance device 10, however there is no limitation thereto.

In a modified example of the embodiment, vehicles installed with a cruise control device that automatically controls driving according to information presented by the driving assistance device 10 may be employed as the pace cars.

Note that the driving assistance device 10, and the server device 31 of the driving assistance system 30, according to the above embodiments and modified examples, may be implemented by dedicated hardware. Alternatively, a program to implement the functions of the driving assistance device 10 and the server device 31 may be recorded on a computer readable recording medium, and the program recorded on the computer readable recording medium may be read by a computer system and executed such that the computer system operates as the driving assistance device 10 and the server device 31. Note that a computer system referred to here includes an OS and hardware, such as peripheral devices. The computer system may include a WWW system equipped with a homepage presentation environment (or display environment).

A computer-readable recording medium referred to here means a portable medium such as a flexible disk, magneto-optical disk, ROM, a CD-ROM, or a storage device installed in a computer system, such as a hard disk. Moreover, the computer-readable recording medium also includes media such as volatile memory (RAM) within a computer system acting as a server or client, that temporarily retains a program in cases where the program has been transmitted over communication lines, for example a network such as the internet, or telecommunication lines.

The above program may be transmitted from a computer system in which the program has been stored on a storage device or the like, to another computer system is a transmission medium, or by propagating waves in a transmission medium. The transmission medium transmitting the program refers to a medium with the function to transmit information such as a network (communication network) such as the internet, or using a communication channel (communication line) such as a telecommunication line.

The above program may be a program that implements part of the functionality described above. Moreover, it may be a program capable of implementing the functionality described above in combination with a program already stored on a computer system, a so-called difference file (difference program).

The above embodiments are merely provided as examples, and are not intended to limit the range of the present application. The novel embodiments described above are implementable in various other modes, and various omissions, replacements, and modifications may be performed within a range not departing from the spirit of the present application. Such embodiments and their modifications are included within the range and spirit of the present application, and are included in within the range of technology recited in the patent claims and their equivalents. For example, in the above embodiments an example is given configured with a single server device 31, however configuration may include plural server devices connected together through communication lines or the like.

What is claimed is:

1. A driving assistance method for assisting a driver to drive a vehicle provided with an electronic device that comprises an acceleration acquisition device that acquires information indicating a change in an acceleration of the vehicle, and an information presentation device that presents information to the driver, the information indicating that a lane change should be restricted when driving on a travel path having multiple lanes, the method comprising:

a congestion warning sign information acquisition step of, by the electronic device, acquiring congestion warning sign information based on the information indicating the change in the acceleration acquired by the acceleration acquisition device, the congestion warning sign information indicating whether or not a change in traffic flow tends toward congestion;

a multi-lane information acquisition step of, by the electronic device, acquiring information indicating whether or not a position of the electronic device is on a travel path having multiple lanes;

a restriction information presentation step of, by the information presentation device, presenting to the driver the information indicating that the lane change is restricted in cases where the position of the electronic device is on the travel path having multiple lanes and the congestion warning sign information indicates that the change in traffic flow tends toward congestion;

a non-restriction information presentation step of, by the information presentation device, presenting the information indicating that lane change is not restricted in cases where the position of the electronic device is on the travel path having multiple lanes and the congestion warning sign information does not indicate that the change in traffic flow tends toward congestion;

a detection step of, by the electronic device, detecting a proportion of a number of driving assistance enabled vehicles to a total number of vehicles in a specific travel path range; and a presentation operation change step of, by the electronic device, changing a manner of operation of the information presentation device so as to present the information indicating whether or not the lane change is restricted according to the proportion of the number of driving assistance enabled vehicles to the total number of vehicles in the specific travel path range.

2. The driving assistance method according to claim 1, wherein in the restriction information presentation step, the information presentation device presents the information indicating that the lane change is restricted together with information prompting a change tending to reduce an inter-vehicle distance or inter-vehicle time.

3. The driving assistance method according to claim 1, wherein in the non-restriction information presentation step, the information presentation device presents information recommending the lane change by presenting the information indicating that the lane change is not restricted in cases where the electronic device receives information indicating a recommendation to travel in another lane based on road information or traffic information.

4. A computer program executable by a computer of an electronic device installed in a vehicle comprising an acceleration acquisition device that acquires information indicating a change in an acceleration of the vehicle and an information presentation device that presents information to the driver, the information indicating that a lane change should be restricted when driving on a travel path having multiple lanes, to execute steps comprising:

a congestion warning sign information acquisition step, by the electronic device, acquiring congestion warning sign information based on the information indicating the change in the acceleration acquired by the acceleration acquisition device, the congestion warning sign information indicating whether or not a change in traffic flow tends toward congestion;

a multi-lane information acquisition step of, by the electronic device, acquiring information indicating whether or not a position of the electronic device is on a travel path having multiple lanes;

a restriction information presentation step of, by the information presentation device, presenting the information indicating that the lane change is restricted in cases where the position of the electronic device is on the travel path having multiple lanes and the congestion warning sign information indicates that the change in traffic flow tends toward congestion;

a non-restriction information presentation step of, by the information presentation device, presenting the information indicating that the lane change is not restricted in cases where the position of the electronic device is on the travel path having multiple lanes and the congestion warning sign information does not indicate that the change in traffic flow tends toward congestion;

a detection step of, by the electronic device, detecting a proportion of a number of driving assistance enabled vehicles to a total number of vehicles in a specific travel path range; and a presentation operation change step of, by the electronic device, changing a manner of operation of the information presentation device so as to present the information indicating whether or not the lane change is restricted according to the proportion of the number of driving assistance enabled vehicles to the total number of vehicles in the specific travel path range.

5. The computer program according to claim 4, wherein in the restriction information presentation step, the program causes the information presentation device to present the information indicating that the lane change is restricted together with information prompting a change tending to reduce an inter-vehicle distance or inter-vehicle time.

6. The computer program according to claim 4, wherein in the non-restriction information presentation step, the program causes the information presentation device to present information recommending the lane change by presenting the information indicating that lane change is not restricted in cases where the electronic device receives information indicating a recommendation to travel in another lane based on road information or traffic information.

7. A driving assistance device for assisting a driver to drive a vehicle, comprising:

an acceleration acquisition device that acquires information indicating a change in an acceleration of the vehicle;

an information presentation device that presents information to the driver the information indicating that a lane change should be restricted when driving on a travel path having multiple lanes;

a congestion warning sign information acquisition device that acquires congestion warning sign information based on the information indicating the change in the acceleration acquired by the acceleration acquisition device; and a multi-lane information acquisition device that acquires information indicating whether or not the acceleration acquisition device and the information presentation device are present on the travel path having multiple lanes, wherein the information presentation device presents the information indicating that the lane change is restricted in cases where the information acquired by the multi-lane information acquisition device indicates that the acceleration acquisition device and the information presentation device are present on the travel path having multiple lanes and the congestion warning sign information acquired by the congestion warning sign information acquisition device indicates that the change in traffic flow tends toward congestion; and the information presentation device presents the information indicating that the lane change is not restricted in cases where the information acquired by the multi-lane information acquisition device indicates that the acceleration acquisition device and the information presentation device are present on the travel path having multiple lanes and the congestion warning sign information acquired by the congestion warning sign information acquisition device does not indicate that the change in traffic flow tends toward congestion; and a presentation operation changer that changes a manner of operation of the information presentation device so as to present the information indicating whether or not the lane change is restricted according to a proportion of a number of driving assistance enabled vehicles to a total number of vehicles in a specific travel path range.

8. The driving assistance device according to claim 7, wherein the information presentation device presents the information prompting a change that tends to reduce an inter-vehicle distance or inter-vehicle time when presenting the information indicating that the lane change is restricted.

9. The driving assistance device according to claim 7, further comprising:

a travel recommendation information acquisition device that acquires information indicating a recommendation to travel in another lane based on road information or traffic information, wherein when presenting the information indicating that the lane change is not restricted, the information presentation device presents information indicating a lane change recommendation by presenting the information indicating that the lane change is not -restricted in cases where the travel recommendation information acquisition device receives information indicating a recommendation to travel in another lane based on the road.

* * * * *